US010355422B2

(12) United States Patent
Sakaizawa

(10) Patent No.: US 10,355,422 B2
(45) Date of Patent: Jul. 16, 2019

(54) ELECTRICAL CONNECTOR EQUIPPED WITH SIGNAL TERMINAL AND GROUND TERMINAL, AND ELECTRICAL CONNECTOR DEVICE USING THEREOF

(71) Applicant: HIROSE ELECTRIC CO., LTD., Tokyo (JP)

(72) Inventor: Tadashi Sakaizawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/087,753

(22) PCT Filed: May 2, 2017

(86) PCT No.: PCT/JP2017/017214

§ 371 (c)(1),
(2) Date: Sep. 24, 2018

(87) PCT Pub. No.: WO2017/199756

PCT Pub. Date: Nov. 23, 2017

(65) Prior Publication Data

US 2019/0115697 A1 Apr. 18, 2019

(30) Foreign Application Priority Data

May 16, 2016 (JP) ..... 2016-097943

(51) Int. Cl.
*H01R 13/659* (2011.01)
*H01R 13/6597* (2011.01)
(Continued)

(52) U.S. Cl.
CPC ..... *H01R 13/6597* (2013.01); *H01R 12/725* (2013.01); *H01R 13/6463* (2013.01); *H01R 13/6471* (2013.01); *H01R 24/62* (2013.01)

(58) Field of Classification Search
CPC ..... H01R 13/6597
See application file for complete search history.

(56) References Cited

U.S. PATENT DOCUMENTS 6,447,311 B1 9/2002 Hu
2008/0020654 A1 1/2008 He
(Continued)

FOREIGN PATENT DOCUMENTS

JP 2010267503 A 11/2010
JP 2010287560 A 12/2010

OTHER PUBLICATIONS

International Search Report dated Aug. 1, 2017 filed in PCT/JP2017/017214.

*Primary Examiner* — James Harvey
(74) *Attorney, Agent, or Firm* — Rankin, Hill & Clark LLP

(57) ABSTRACT

Provided are an electrical connector capable of connecting a ground terminal to a ground with a simple structure without connection to a drain wire, and an electrical connector device using the electrical connector. The electrical connector includes signal terminals and the ground terminal, an insulating housing for holding the signal terminals and the ground terminal, and a conductive shell covering at least a part of side outer peripheries of the signal terminals and the ground terminal. The signal terminals form pairs, and the ground terminal is disposed between the pairs of signal terminals. A part of the ground terminal is in direct contact with an inner wall of the conductive shell.

8 Claims, 8 Drawing Sheets

(51) Int. Cl.

| | |
|---|---|
| ***H01R 13/6471*** | (2011.01) |
| ***H01R 12/72*** | (2011.01) |
| ***H01R 13/6463*** | (2011.01) |
| ***H01R 24/62*** | (2011.01) |

(56) References Cited

U.S. PATENT DOCUMENTS

| | | | | |
|---|---|---|---|---|
| 2009/0286419 | A1* | 11/2009 | Koyama | H01R 27/02 439/358 |
| 2010/0173524 | A1 | 7/2010 | Zhu | |
| 2010/0291798 | A1 | 11/2010 | Kondo | |
| 2011/0130014 | A1 | 6/2011 | Zhu | |
| 2013/0288528 | A1* | 10/2013 | Sakaizawa | H01R 13/518 439/626 |
| 2018/0026410 | A1* | 1/2018 | Tsai | H01R 13/502 439/607.09 |
| 2018/0138614 | A1* | 5/2018 | Zhao | H01R 24/60 |
| 2018/0166830 | A1* | 6/2018 | Feng | H01R 13/6593 |
| 2018/0358755 | A1* | 12/2018 | Sakaizawa | H01R 13/6582 |
| 2019/0058289 | A1* | 2/2019 | Sakaizawa | H01R 13/639 |

* cited by examiner

ELECTRICAL CONNECTOR EQUIPPED WITH SIGNAL TERMINAL AND GROUND TERMINAL, AND ELECTRICAL CONNECTOR DEVICE USING THEREOF

TECHNICAL FIELD

The present invention relates to an electrical connector equipped with signal terminals and a ground terminal, and an electrical connector device using the same.

BACKGROUND ART

An example of such an electrical connector is shown in Patent Literature 1. In this type of electrical connector, it is attempted to reduce crosstalk generated between a pair of signal terminals by arranging a ground terminal between the pair of signal terminals, which are respectively connected to a twisted pair cable and used for transmission of a differential signal. In this case, the ground terminal is generally connected to a drain wire housed in the pair cable or is arranged without being connected to any portion when the drain wire is not used.

CITATION LIST

Patent Literature

Patent Literature 1: JP-A-2010-287560

SUMMARY OF THE INVENTION

Problems to be Solved by the Invention

When the ground terminal is connected to the drain wire, the crosstalk can be reduced more efficiently, however, work of connecting the ground terminal to the drain wire is complicated, resulting in an increase in product cost. On the other hand, when the drain wire is not used, problem of the crosstalk naturally tends to become apparent, and particularly in recent years, as a size of the connector is reduced, a pitch between the terminals is reduced, and since high-speed transmission of high-frequency signal is desired, the problem of crosstalk becomes larger.

The present invention has been made in order to solve such problems in the related art, and an object of the present invention is to provide an electrical connector capable of connecting a ground terminal to a ground with a simple structure without connection to a drain wire, and to provide an electrical connector device using the same.

Solution to the Problems

In order to solve the above problem, an electrical connector according to an aspect of the present invention includes signal terminals and a ground terminal, an insulating housing for holding the signal terminals and the ground terminal, and a conductive shell covering at least a part of side outer peripheries of the signal terminals and the ground terminal, wherein the signal terminals form pairs, the ground terminal is disposed between the pairs of signal terminals, and a part of the ground terminal is in direct contact with an inner wall of the conductive shell.

According to the electrical connector of this aspect, by bringing the ground terminal into direct contact with the conductive shell, it is possible to connect the ground terminal to the ground with the simple structure without connection to the drain wire, and thus it is possible to simplify the structure of the device and to reduce cost of producing the device. Further, by arranging the ground terminal between the pairs of signal terminals, it is possible to suppress crosstalk occurring between the pairs of signal terminals In the electrical connector of the above aspect, it is preferred that the signal terminals or the ground terminal have the same size and shape in a portion located on an insertion-removal side of a mating connector with respect to a portion fixed by the insulating housing.

According to the electrical connector of this aspect, by making parts of the signal terminals and a part of the ground terminal have the same size and shape, it is possible to obtain effects such as easy production of the electrical connector.

In the electrical connector of the above aspect, it is preferred that parts of the signal terminals and a part of the ground terminal are arranged in a line in a pitch direction of the signal terminals and the ground terminal in the portion located on the insertion-removal side of the mating connector with respect to the portion fixed by the insulating housing.

According to the electrical connector of this aspect, by arranging the parts of the signal terminals and the part of the ground terminal in a line, it is possible to obtain effects such as easy production of the electrical connector.

In the electrical connector of the above aspect, it is preferred that a load is applied to a part of the ground terminal in direct contact with the inner wall of the conductive shell toward a side in contact with the inner wall of the conductive shell.

According to the electrical connector of this aspect, by applying the load in advance, it is possible to bring a part of the ground terminal into direct contact with the conductive shell by merely holding the ground terminal in the insulating housing.

In the electrical connector of the above aspect, it is preferred that a part of the ground terminal in direct contact with the inner wall of the conductive shell is located on a side opposite to an insertion-removal side of the mating connector with respect to the portion fixed by the insulating housing.

According to the electrical connector of this aspect, it is possible to bring the ground terminal into contact with the conductive shell without suppressing fitting of a cable connector 10 and a board connector 70.

In the electrical connector of the above aspect, it is preferred that a part of the ground terminal in direct contact with the inner wall of the conductive shell is located on an insertion-removal side of the mating connector with respect to the portion fixed by the insulating housing.

According to the electrical connector of this aspect, it is possible to bring the ground terminal into direct contact with the conductive shell without increasing the size of the electrical connector.

In the electrical connector of the above aspect, it is preferred that a part of the ground terminal in direct contact with the inner wall of the conductive shell is provided to be slidable with respect to the inner wall of the conductive shell.

According to the electrical connector of this aspect, it is possible to smoothly make contact between the ground terminal and the terminal of the mating connector.

The electrical connector of the above aspect may be paired with the mating connector to form an electrical connector device.

Effects of the Invention

According to the present invention, it is possible to provide an electrical connector capable of connecting a ground terminal to a ground with a simple structure without connection to a drain wire, and an electrical connector device using the same.

DESCRIPTION OF THE EMBODIMENTS

Hereinafter, an electrical connector according to a preferred embodiment of the present invention and an electrical connector device using the same will be described with reference to the accompanying drawings.

Figure 1:
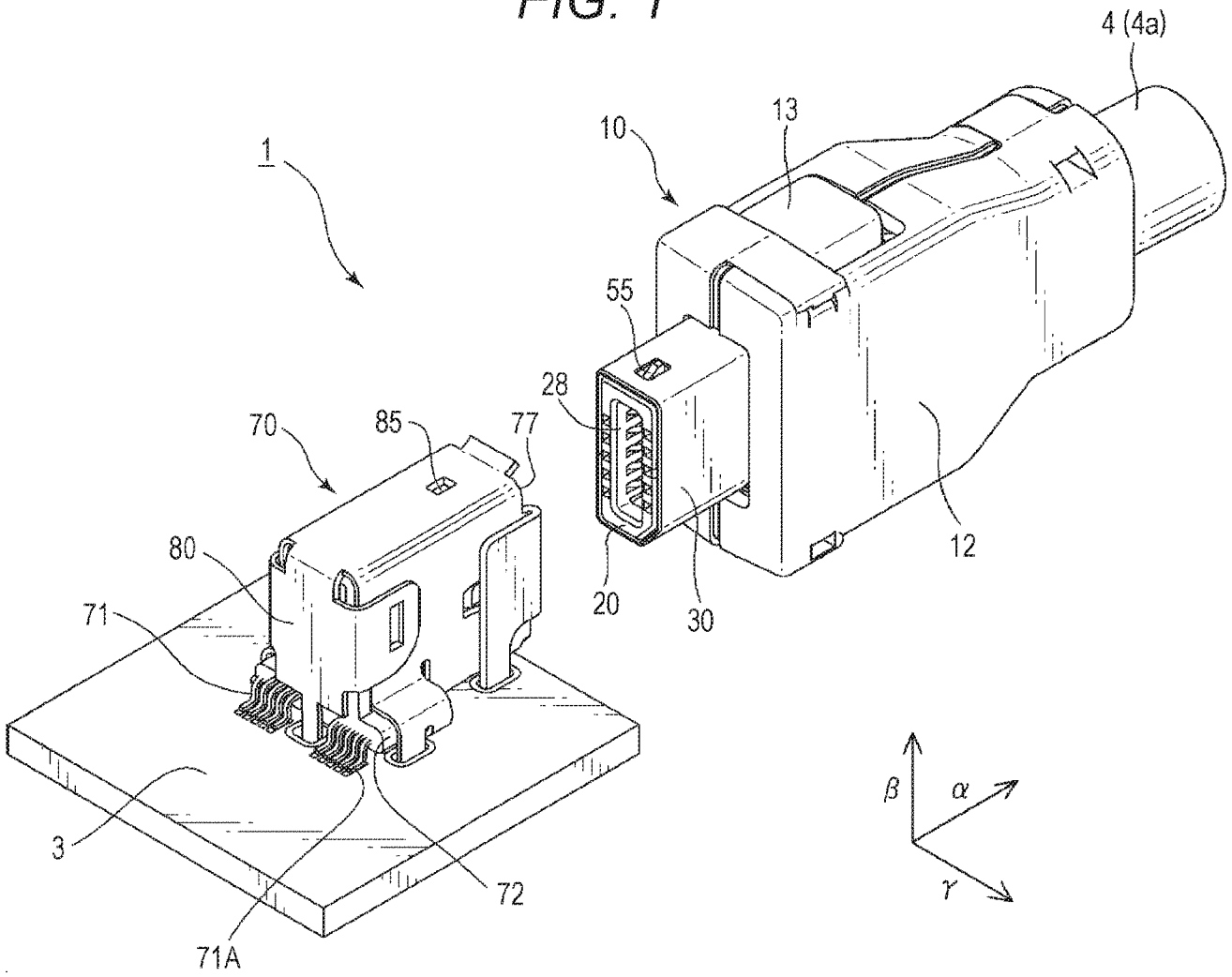
FIG. 1 is a perspective view of an electrical connector device according to a first embodiment of the present invention.

FIG. 1 is a perspective view showing an example of a use state of an electrical connector device 1 according to a first embodiment of the present invention. The electrical connector device 1 includes a set of an electrical connector 10 and a mating connector 70 which can be attached to and detached from each other through insertion-removal, for example, fitting and removal work. The electrical connector 10 may be, for example, a cable connector connected to an electrical cable 4, and the mating connector 70 may be, for example, a board connector connected to a board 3. The cable connector 10 and the board connector 70 may be considered to have substantially symmetrical shapes.

The board connector 70 mainly includes an insulating housing 72, a terminal 71 held by the insulating housing 72 with a part thereof exposed from the insulating housing 72, and, further, a conductive shell 80 substantially covering an outer periphery other than a front side and a bottom side of the insulating housing 72.

A fitting hole 77 is provided on a front surface of the insulating housing 72, and further a fitting convex portion (not shown) matching a fitting concave portion 28 provided in an insulating housing 20 of the electrical connector 10 is provided in the fitting hole 77. One end side of the terminal 71 is arranged exposed in the fitting convex portion while the other end side 71A of the terminal 71 is soldered to the board 3.

The cable connector 10 and the board connector 70 can be engaged with each other or can be disengaged by moving in an arrow "α" direction in the drawing. Here, arrows "α", "β", "γ" shown in the drawing are substantially perpendicular to each other. When the cable connector 10 and the board connector 70 are fitted together, a conductive shell 30 of the cable connector 10 exposed from a hood 12 and a tip end portion of the insulating housing 20 are inserted into the substantially rectangular fitting hole 77 provided on a front surface of the board connector 70, and locking portions elastically protruding from upper and lower portions of the conductive shell 30 of the cable connector 10, for example, locking projections 55 displaceable in an arrow "β" direction shown in the drawing are fitted into locked portions, for example, through-holes 85 provided on a ceiling portion and a bottom plate portion of the conductive shell 80 of the board connector 70. As a result, fitting between the cable connector 10 and the board connector 70 is locked. A locked state can be released by moving the locking projections 55 due to an operation of a button 13 provided on the cable connector 10.

Figure 2:
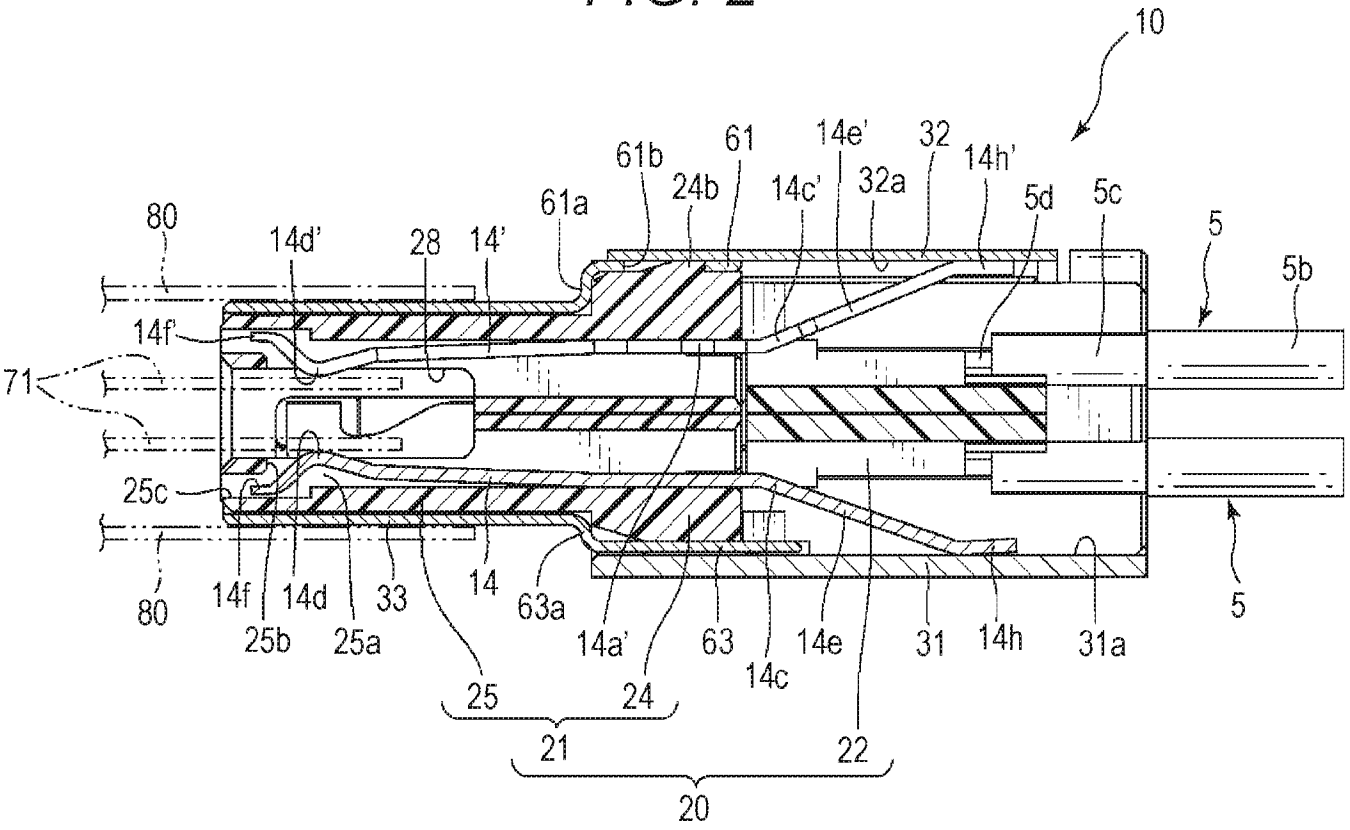
FIG. 2 is a center line cross-sectional view of an electrical connector according to the first embodiment of the present invention.
Figure 3:
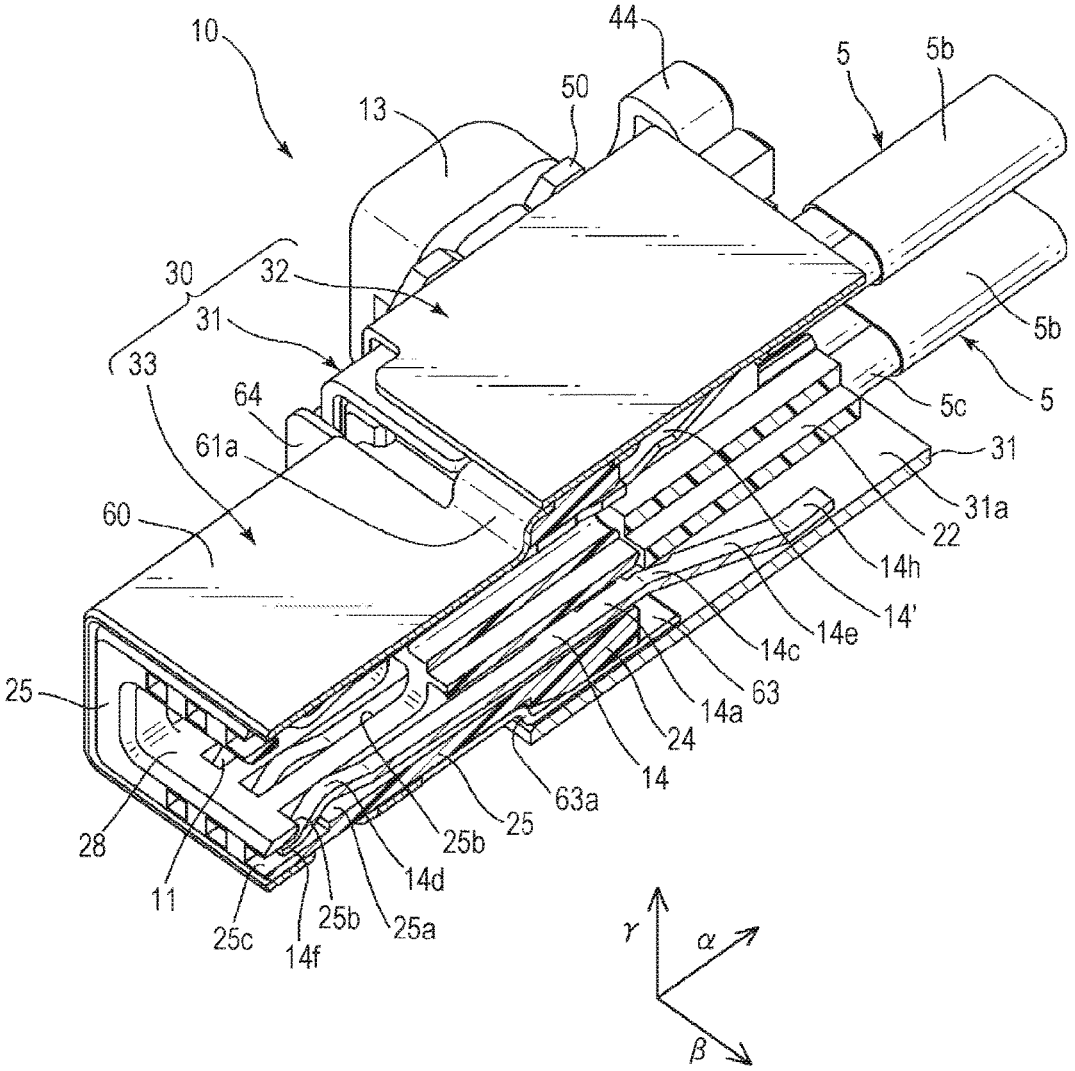
FIG. 3 is a perspective view of FIG. 2.

FIG. 2 is a center line cross-sectional view of the cable connector 10 shown in FIG. 1, and FIG. 3 is a perspective view of FIG. 2. For the sake of clarity, FIG. 2 shows, by two-dot chain lines, the terminal 71 on the board connector 70 side and a part of the shell 80 shown in FIG. 1, and in FIGS. 2 and 3, the hood 12 of the cable connector 10 and an outer coating portion 4*a*, shown in FIG. 1, provided on the electrical cable 4 are omitted. As is apparent from the drawings, one electrical cable 4 shown in FIG. 1 includes a total of four twisted pair cables 5 (only two twisted pair cables 5 are shown in FIGS. 2 and 3). Each twisted pair cable 5 includes one inner tube 5*b*, one inner tube 5*b* includes two insulating coatings 5*c*, and each insulating coating 5*c* includes one conductive wire 5*d*.

The cable connector 10 mainly includes the insulating housing 20, a plurality of signal terminals 11 and a ground terminal 14 held in the insulating housing 20 with parts thereof exposed from the insulating housing 20, the conductive shell 30 covering a side outer periphery substantially in a longitudinal direction of the plurality of signal terminals 11 and the ground terminal 14, and, further, the insulating hood 12 which is omitted for convenience in FIGS. 2 and 3 and covers an outer periphery of the conductive shell 30. Although it is preferred that the conductive shell 30 covers the entire side outer periphery of the signal terminals 11 and the ground terminal 14, it is not always necessary to cover the entire thereof, but it is sufficient if the conductive shell 30 covers at least a part thereof.

The insulating housing 20 includes a main body housing 21 and an auxiliary housing 22 housed inside the main body housing 21. The main body housing 21 holds a front side of the signal terminals 11 and the ground terminal 14, that is, an insertion-removal side of the cable connector 10 and the board connector 70, while the auxiliary housing 22 holds a rear side of the signal terminals 11 and the ground terminal 14 side, that is, an opposite side to the insertion-removal side of the cable connector 10 and the board connector 70. The main body housing 21 is formed in a tubular shape having a substantially rectangular cross-section as a whole, and includes a large diameter main body 24 and a small diameter inserted portion 25 extending from the main body 24 to the front side (insertion-removal side).

The conductive shell 30 includes a main body shell 31, a plate-like shell 32, and a tubular shell 33. Any of them are produced by punching and bending a single metal plate, and have some elasticity. The main body shell 31, the plate-like shell 32, and the tubular shell 33 are physically and electrically connected to each other, so that any of them can exert a ground function.

Figure 4:
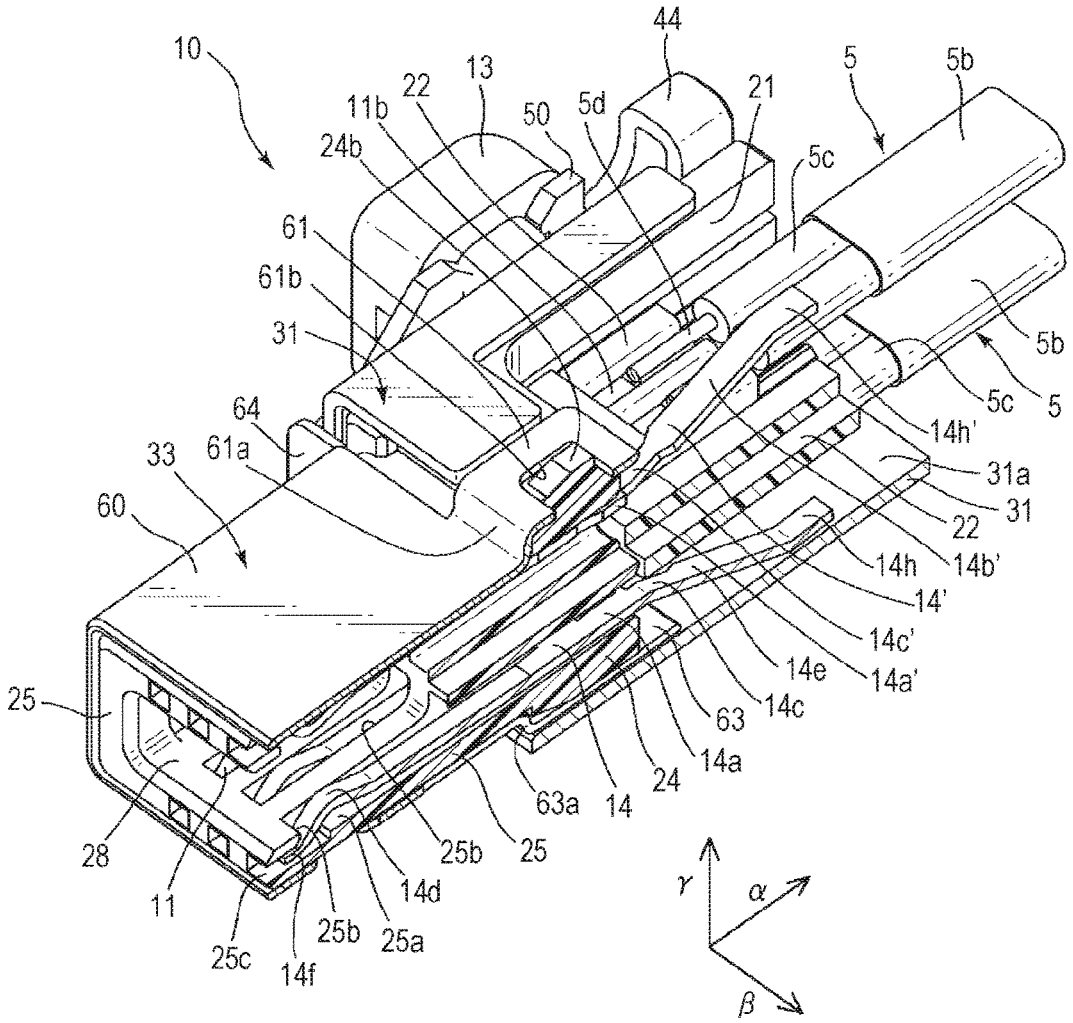
FIG. 4 is a perspective view in which a plate-like shell is removed from FIG. 3.

FIG. 4 is a perspective view in which the plate-like shell 32 is removed from FIG. 3. The main body shell 31 has a substantially C-shaped cross-section as a whole, and mainly covers a side outer periphery of the main body 24 of the insulating housing 20 and a part of a side outer periphery of the auxiliary housing 22. The main body shell 31 is provided with an elastic arm 50 connected by a support portion 44, the locking projection 55 shown in FIG. 1 is formed as a part of the elastic arm 50, and the button 13 for operating the locking projection 55 is fixed to the elastic arm 50.

The plate-like shell 32 has a substantially U-shaped cross-section as a whole, and is mainly attached to the main body shell 31, to cover the side outer periphery of the main body 24 of the insulating housing 20 and the side outer periphery of the auxiliary housing 22, which are not covered by the main body shell 31.

The tubular shell 33 is a tubular body having a substantially rectangular cross-section as a whole and mainly covers an outer periphery of the inserted portion 25 of the insulating housing 20. The tubular shell 33 has a tubular main body 60, and a standing piece 64, a stepped portion 61*a*, and a stepped portion 63*a*, which extend radially from the main body 60. When the cable connector 10 and the board connector 70 are fitted together, the main body 60 is connected to a part of the shell 80 of the board connector 70 (see FIG. 2), and through this connection, the conductive shell 30 of the cable connector 10 and the shell 80 of the board connector 70 are electrically connected to each other. The tubular shell 33 is stably positioned with respect to the insulating housing 20 and the main body shell 31 by inserting the inserted portion 25 of the insulating housing 20 into the main body 60 and abutting the standing piece 64, the stepped portion 61*a*, and the stepped portion 63*a* against predetermined portions of the insulating housing 20 and the main body shell 31. The tubular shell 33 can be fixed to the insulating housing 20, for example, by fitting a locking protrusion 24*b* protruding to an outer surface of the insulating housing 20 into a locking hole 61*b* of an attachment piece 61 extending toward the main body shell 31 via the stepped portion 61*a*, and so as to sandwich an attachment piece 63 connected to the stepped portion 63*a* from the outside by the main body shell 31.

Figure 5:
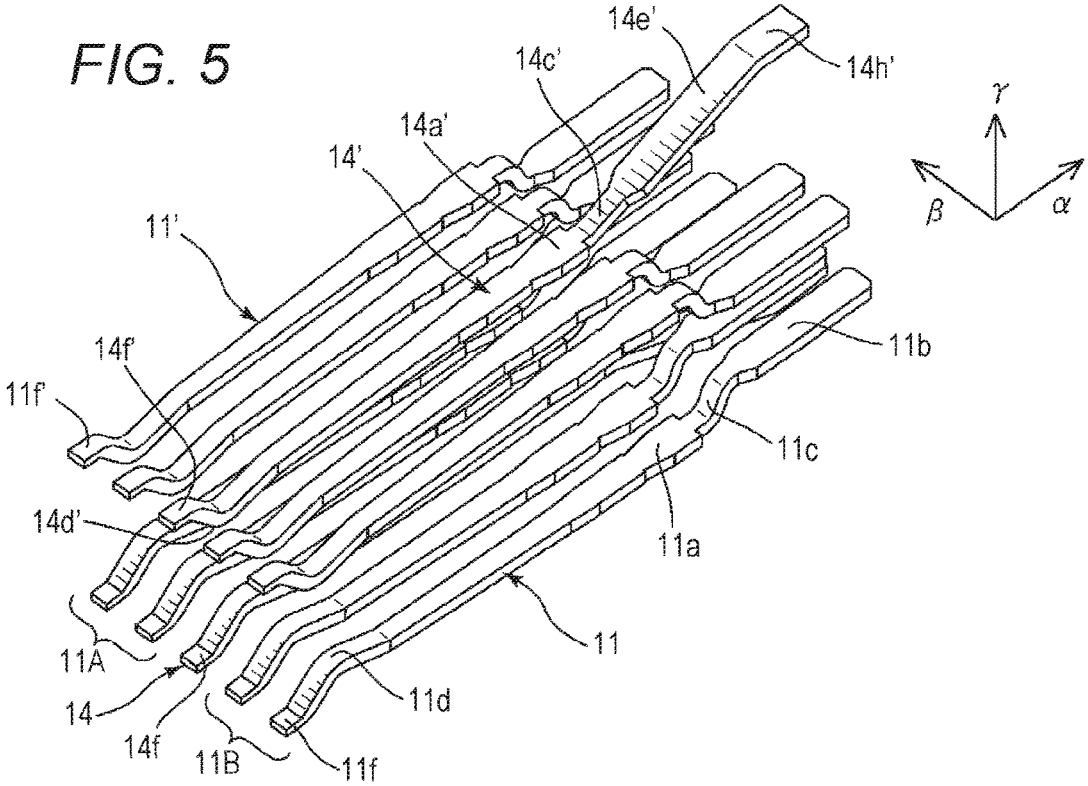
FIG. 5 is a perspective view showing an arrangement state of terminals.
Figure 6:
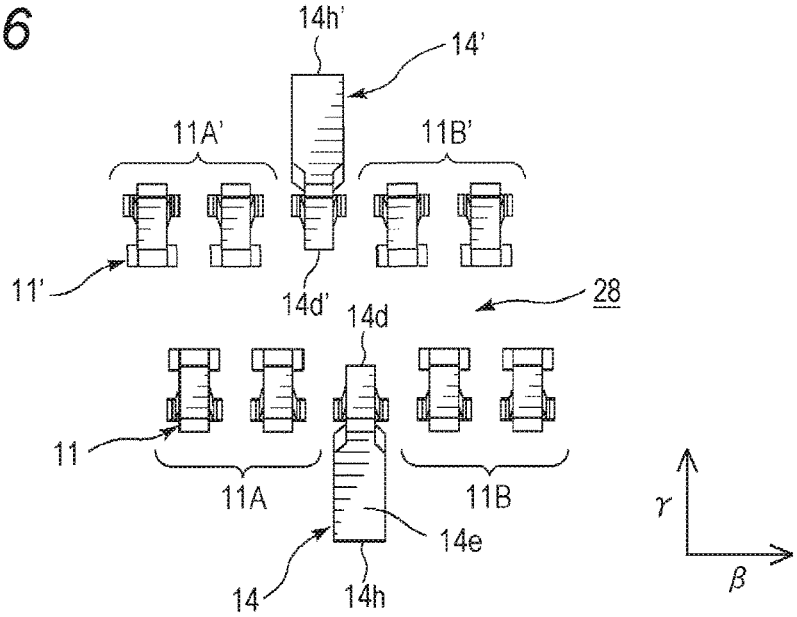
FIG. 6 is a front view of FIG. 5.

The signal terminal 11 and the ground terminal 14 may be produced by punching and bending a single metal plate. FIGS. 5 and 6 show an arrangement state of the signal terminals 11 and the ground terminal 14 in the insulating housing 20. FIG. 5 is a perspective view showing the arrangement state, and FIG. 6 is a front view of the arrangement state.

The signal terminals 11 and the ground terminals 14 form two sets of terminal groups. Each terminal group includes four signal terminals 11 and one ground terminal 14, which are horizontally arranged at the same pitch in the "β" direction, in an order of the signal terminal 11, the signal terminal 11, the ground terminal 14, the signal terminal 11, and the signal terminal 11 in this order. In each terminal group, two adjacent signal terminals 11 respectively arranged on the left and right sides with the ground terminal 14 therebetween form pairs 11A and 11B for transmitting differential signals, and two conductive wires for transmitting the differential signals included in each twisted pair cable are respectively connected to the two signal terminals 11 included in each pair. The one ground terminal 14 is disposed to be sandwiched from both sides between the pair 11A and the pair 11B which are the two sets of signal terminals 11 arranged in the "β" direction. In this manner, by arranging the ground terminal 14 between the pair 11A and the pair 11B of the signal terminals 11, it is possible to suppress crosstalk between the pairs.

The two sets of terminal groups are respectively arranged at a position of sandwiching the fitting convex portion (not shown) of the board connector 70, for example, so as to face each other with the fitting concave portion 28 therebetween on an "upper side" and a "lower side" in an example of FIGS. 5 and 6. As is well shown in FIG. 6, the upper terminal group 11', 14' and the lower terminal group 11, 14 are shifted one pitch from each other in the "β" direction. Hereinafter, only when it is necessary to distinguish the upper terminal group from the lower terminal group, the terminal included in the upper terminal group is shown by adding "'" to the same reference numeral as the terminal included in the lower terminal group.

Figure 7:
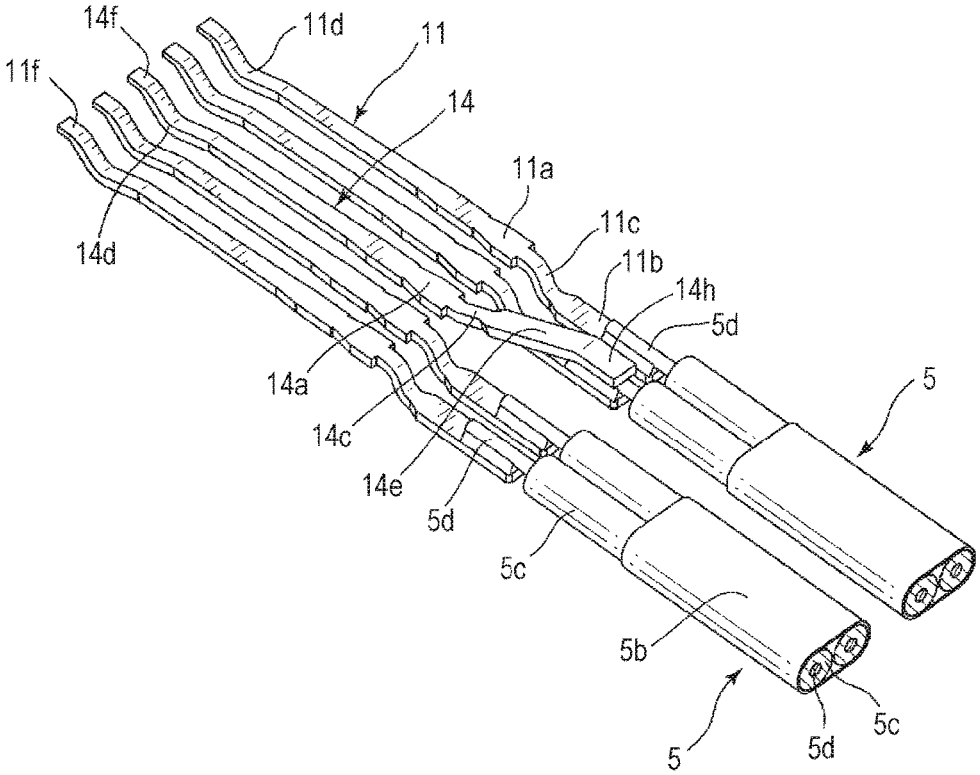
FIG. 7 is a schematic perspective view showing an attachment state of a signal terminal and a twisted pair cable.
Figure 8:
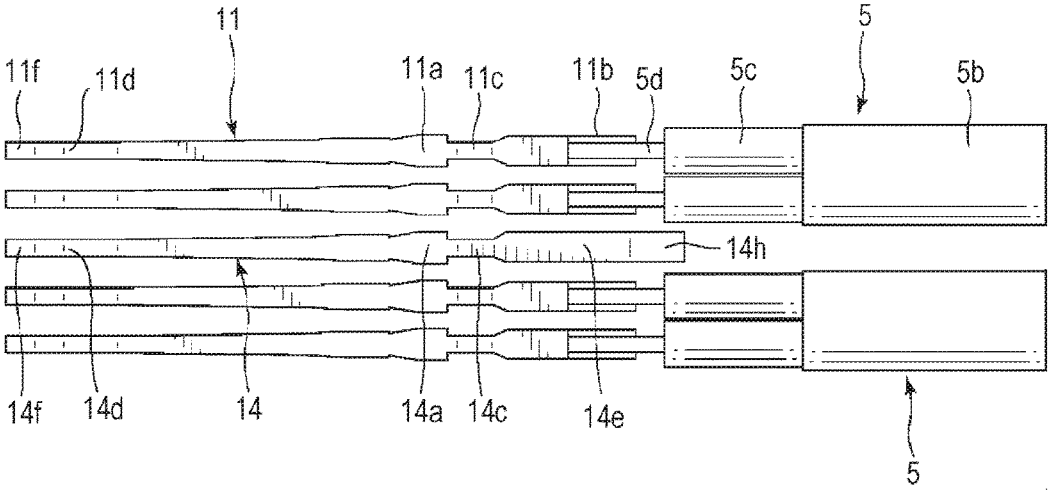
FIG. 8 is a plan view of FIG. 7.

Each signal terminal 11 includes, substantially in the longitudinal direction, a base portion 11*a*, a contact point 11*d* located on the front side with respect to the base portion 11*a*, a conductive wire attachment portion 11*b* located on the rear side (opposite side to the insertion-extraction side) with respect to a base portion 14*a*, and a neck portion 11*c* connecting the base portion 14*a* and the conductive wire attachment portion 11*b*. The base portion 11*a* is formed wide and fixed to the main body 24 (see FIG. 2 and the like) of the main body housing 21 constituting the insulating housing 20 by press fitting or the like, and the conductive wire attachment portion 11*b* is fixed to the auxiliary housing 22 (see FIG. 2 and the like) constituting the housing 20 by press fitting or the like. As shown in FIGS. 7 and 8, the conductive wires 5*d* included in the twisted pair cables 5 are respectively attached to the conductor attachment portions 11*b* fixed to the auxiliary housing 22. Here, FIG. 7 is a schematic perspective view showing the attachment state of the signal terminal 11 and the twisted pair cable 5, and FIG. 8 is a plan view of the attachment state. The contact point 11*d* can contact the predetermined terminal 71 of the board connector 70 (like the ground terminal 14 shown in FIG. 2) when the cable connector 10 and the board connector 70 are fitted together.

On the other hand, each ground terminal 14 includes a base portion 14*a*, a contact point 14*d* located on the front side with respect to the base portion 14*a*, a shell contact portion 14*e* located on the rear side with respect to the base portion 14*a*, and a neck portion 14*c* connecting the base portion 14*a* and the shell contact portion 14*e*. The base portion 14*a* is fixed to the main body 24 (see FIG. 2 and the like) of the main body housing 21 constituting the insulating housing 20 by press fitting or the like. The contact point 14*d* can contact the predetermined terminal 71 of the board connector 70 (see FIG. 2) when the cable connector 10 and the board connector 70 are fitted together.

As shown in FIGS. 2 to 4 and the like, the shell contact portion 14*e* is used in a state of being always in contact with an inner wall of the conductive shell 30. An end portion 14*h'* of an upper shell contact portion 14*e'* is in direct contact with an inner wall 32*a* of the plate-like shell 32 constituting the conductive shell 30, and an end portion 14*h* of a lower shell contact portion 14*e* is in direct contact with an inner wall 31*a* of the main body shell 31 constituting the conductive shell 30. In this way, by bringing the ground terminal 14 and the conductive shell 30 into direct contact with each other, it is not necessary to connect the drain wire included in the cable connector to the ground terminal. As a result, it is possible to simplify a structure of the device, and to reduce cost of producing the device. Since the shell contact portion 14*e* is located on the rear side with respect to the base portion 14*a* fixed to the insulating housing 20, the fitting between the cable connector 10 and the board connector 70 is not hindered. Incidentally, the term "direct contact" as used herein means that they are electrically in direct contact with each other, and accordingly includes contact via solder, conductive resin or the like.

In order to bring the shell contact portion 14*e* into contact with the conductive shell 30, the neck portion 14*c* is bent toward the conductive shell 30. Prior to fixing the ground terminal 14 to the insulating housing 20, it is preferred that a load is applied to the shell contact portion 14*e* in advance toward a side in contact with the inner walls 31*a*, 32*a* of the conductive shell 30 by using the neck portion 14*c* or the like. Thus, by merely holding the ground terminal in the insulating housing, it is possible to bring a part of the ground terminal into direct contact with the conductive shell.

As shown in FIGS. 2 to 4 and the like, front ends 11*f* and 14*f* of the signal terminal 11 and the ground terminal 14 are arranged in vertically elongated housing grooves 25*a* of the insulating housing 20. At this time, the front ends 11*f* and 14*f* are opposed to the conductive shell 30 via a partition wall 25*c* of a main body 25 of the insulating housing 20, and do not come into contact with the conductive shell 30. An opening 25*b* is provided in an upper portion of each housing groove 25*a*, so that vicinities of the contact points 11*d* and 14*d* of the signal terminal 11 and the ground terminal 14 are exposed to the fitting concave portion 28 of the insulating housing 20. When the cable connector 10 and the board connector 70 are fitted together, the signal terminal 11 and the ground terminal 14 can be brought into contact with predetermined terminals 71 (see FIG. 1) of the board connector 70 through the openings 25*b*.

It is preferred that the base portions 11*a* and 14*a* of the signal terminal 11 and the ground terminal 14 and portions located on the front side with respect to the base portions 11*a* and 14*a*, for example, the contact points 11*d*, 14*d*, the front ends 11*f*, 14*f*, and the like have the same size and shape. By making the same size and shape, it is possible to facilitate production of the electrical connector.

Further, it is preferred that the base portions 11*a* and 14*a* of the signal terminal 11 and the ground terminal 14 constituting each terminal group and portions located on the front side with respect to the base portions 11*a* and 14*a*, for example, the contact points 11*d*, 14*d*, the front ends 11*f*, 14*f* and the like are arranged in a line in a pitch direction "β" of the signal terminal 11 and the ground terminal 14. This can facilitate the production of the electrical connector.

For the same reason, it is preferred that the upper and lower signal terminals 11 or the upper and lower ground terminals 14 all have the same size and shape.

Figure 9:
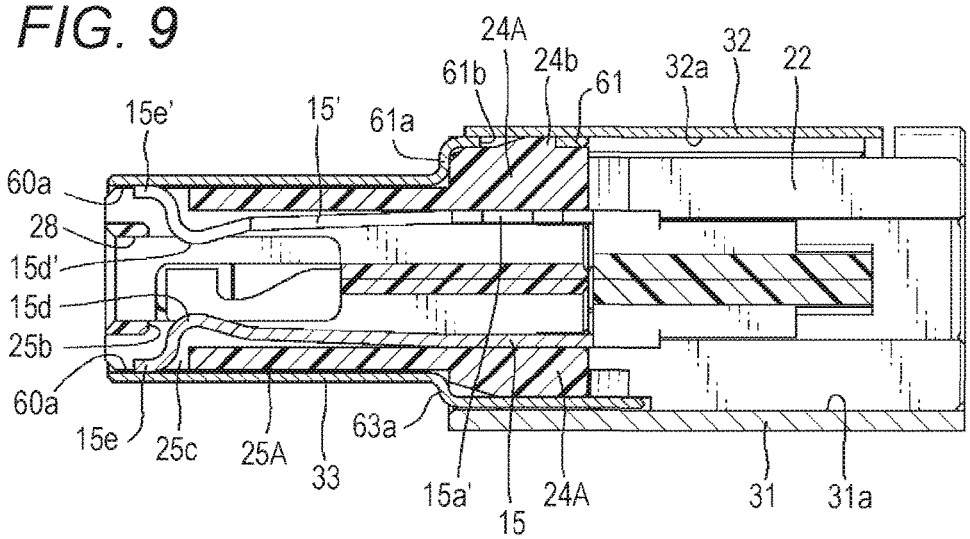
FIG. 9 is a center line cross-sectional view of the electrical connector according to a second embodiment of the present invention.
Figure 10:
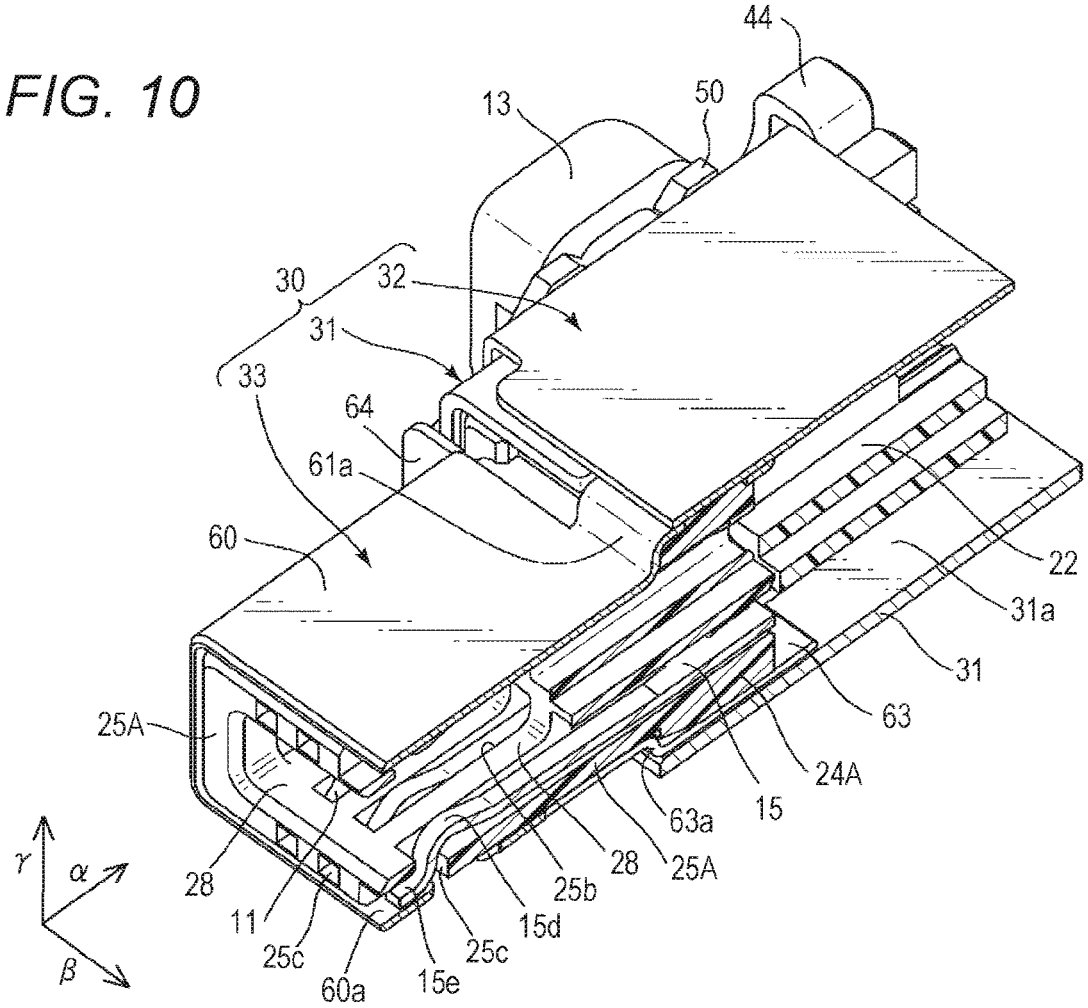
FIG. 10 is a perspective view of FIG. 9.
Figure 11:
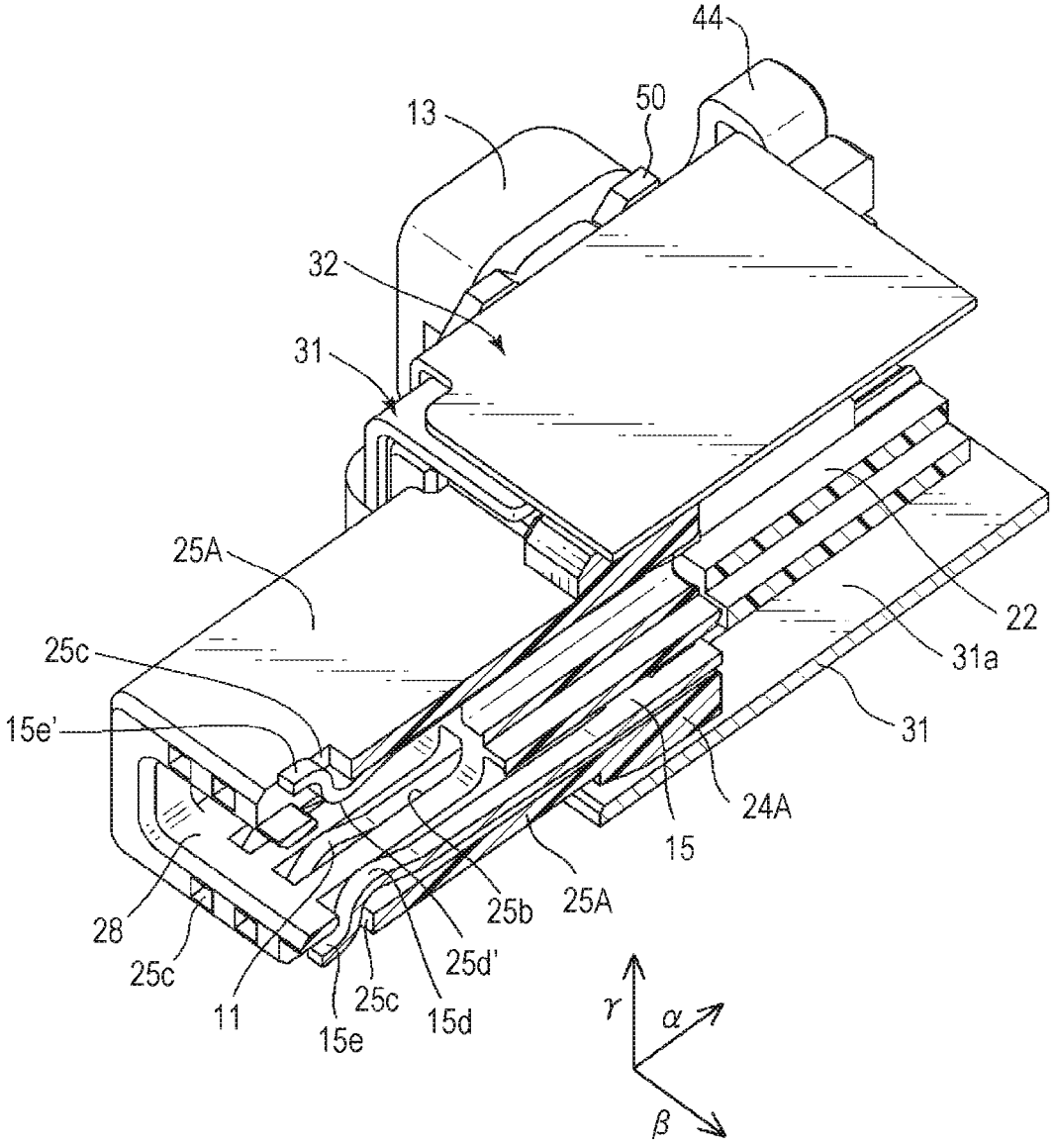
FIG. 11 is a perspective view in which the plate-like shell is removed from FIG. 9.

FIGS. 9 to 11 show a second embodiment of the present invention. These FIGS. 9 to 11 respectively correspond to FIGS. 2 to 4. In the second embodiment, the same members as in the first embodiment are denoted by the same reference numerals.

In the first embodiment, the shell contact portion 14*e* is located on the rear side with respect to the base portion 14*a* fixed to the insulating housing 20, whereas in the second embodiment, the shell contact portion 15*e* is located on the front side with respect to the base portion 15*a* fixed to the insulating housing 20. According to this structure, it is possible to bring the ground terminal 14 into direct contact with the conductive shell 30 without increasing the size of the electrical connector.

In the second embodiment, a front end 15*e* of a ground terminal 15 is used as a shell contact portion. This shell contact portion 15*e* is in direct contact with an inner wall 60*a* of the conductive shell 30 without the insulating housing 20. Since the shell contact portion 15*e* is provided in the vicinity of the contact point 15*d* with the board connector 70, when the cable connector 10 and the board connector 70 are fitted together or when the fitting is released, there is a possibility that the shell contact portion 15*e* moves with respect to the inner wall 60*a*. It is preferred that the shell contact portion 15*e* of the ground terminal 15 is provided to be slidable with respect to the inner wall 60*a* of the conductive shell 30 in order to suppress scraping or the like of the insulating housing 20 during movement of the shell contact portion 15*e*.

It should be noted that the present invention is not limited to the above-described embodiments, and various other modifications can be made. It is therefore to be understood that the embodiments disclosed herein are merely illustrative and not restrictive and that the scope of the present invention should be defined not by the above description but by the appended claims, and includes all changes in the meanings equivalent to claims and within the scope of claims.

LIST OF REFERENCE NUMERALS

1: Electrical connector device
4: Electrical cable
5: Twisted pair cable
10: Cable connector (electrical connector)
11: Signal terminal
11*a*: Base portion (fixed portion)
11*b*: Conductive wire attachment portion
14: Ground terminal
14*a*: Base portion (fixed portion)
14*e*: Shell contact portion
14*h*: End portion
15: Ground terminal
20: Insulating housing
30: Conductive shell
70: Board connector (mating connector)
71: Terminal
72: Insulating housing
80: Conductive shell

The invention claimed is:

1. An electrical connector comprising:
signal terminals and a ground terminal;
an insulating housing for holding the signal terminals and the ground terminal; and
a conductive shell covering at least a part of side outer peripheries of the signal terminals and the ground terminal, wherein
the signal terminals form pairs, the ground terminal is disposed between the pairs of signal terminals, and a part of the ground terminal is in direct contact with an inner wall of the conductive shell.

2. The electrical connector according to claim 1, wherein
the signal terminals or the ground terminal have the same size and shape in a portion located on an insertion-removal side of a mating connector with respect to a portion fixed by the insulating housing.

3. The electrical connector according claim 1, wherein
parts of the signal terminals and a part of the ground terminal are arranged in a line in a pitch direction of the signal terminals and the ground terminal in a portion located on an insertion-removal side of a mating connector with respect to a portion fixed by the insulating housing.

4. The electrical connector according to claim 1, wherein
a load is applied to a part of the ground terminal in direct contact with the inner wall of the conductive shell toward a side in contact with the inner wall of the conductive shell.

5. The electrical connector according to claim 1, wherein
a part of the ground terminal in direct contact with the inner wall of the conductive shell is located on a side opposite to an insertion-removal side of a mating connector with respect to a portion fixed by the insulating housing.

6. The electrical connector according to claim 1, wherein a part of the ground terminal in direct contact with the inner wall of the conductive shell is located on an insertion-removal side of a mating connector with respect to a portion fixed by the insulating housing.

7. The electrical connector according to claim 6, wherein a part of the ground terminal in direct contact with the inner wall of the conductive shell is provided to be slidable with respect to the inner wall of the conductive shell.

8. An electrical connector device comprising the electrical connector according to claim 1 and a mating connector.

* * * * *